United States Patent [19]

Crumrine

[11] 4,233,948

[45] Nov. 18, 1980

[54] POLLUTION CONTROL DEVICE FOR AUTOMOBILE CARBURETION

[75] Inventor: David F. Crumrine, Okmulgee, Okla.

[73] Assignee: Gaines L. Neal, Okmulgee, Okla. ; a part interest

[21] Appl. No.: 29,917

[22] Filed: Apr. 16, 1979

[51] Int. Cl.[3] ..... F02M 29/00

[52] U.S. Cl. ..... 123/590; 48/180 R; 123/593

[58] Field of Search ..... 123/141; 48/180 R, 180 M; 261/DIG. 55

[56] References Cited

U.S. PATENT DOCUMENTS

| | | | |
|---|---|---|---|
| 2,588,474 | 3/1952 | Bellior | 123/141 |
| 2,661,269 | 12/1953 | Briggs | 123/141 |
| 3,322,407 | 5/1967 | Brucar | 123/141 |

*Primary Examiner*—Ronald H. Lazarus
*Attorney, Agent, or Firm*—Head & Johnson

[57] ABSTRACT

For an internal combustion engine a vaporizer interposed between the carburetor and the intake manifold of the engine, the vaporizer comprising a base plate adapted to attach to an intake manifold and an upper plate adapted to attach to a carburetor, a spacing ring between the base plate and the upper plate, the upper plate and base plate having centrally disposed ports, a baffle disposed within the interior of the spacing ring providing an annular opening between the ring and baffle, an upright perforated collar positioned between the baffle and upper plate, the annular area between perforated collar and ring being filled with fibrous material to capture any liquid droplets present in the fuel stream.

1 Claim, 2 Drawing Figures

POLLUTION CONTROL DEVICE FOR AUTOMOBILE CARBURETION

BACKGROUND OF THE INVENTION

1. Field of the Invention

This invention lies in the field of control of fuel mixture for an internal combustion engine. It is particularly related to means of decreasing the hydrocarbons and other pollutants emitted as a byproduct of the combustion process.

2. Description of the Prior Art

Many devices are known in the prior art which accomplish vaporization of the gasoline fuel stream. These include an array of baffles or blades located in the fuel stream to catch liquid components of the fuel stream (Kunik, U.S. Pat. No. 3,940,499), and a rotor mounted within the fuel stream (Ingersoll, U.S. Pat. No. 4,014,306). Others have used steel wool in the intake conduit to break up globule or small droplets of liquid present in the fuel stream.

The devices available in the prior art are generally complicated, expensive, or have moving parts that may interfere with the fuel flow mechanism of the engine. Additionally, some prior art devices have provided for elaborate means to collect and reuse the fuel droplets from the fuel stream. This, of course, generally increases the cost which is a discouraging factor for the consumer.

The present invention is an economical and convenient device which attaches interposed between the inlet manifold and the carburetor of an engine and provides easy means to remove liquid droplets present in the fuel stream and reduce the amount of dangerous pollutants emitted by the engine.

3. Summary of the Invention

The present invention is constructed such that the path of the fuel stream is made to pass through a layer of fibrous material where the droplets present in the fuel stream are captured and retained until they are vaporized. By retaining the liquid droplets in the path of the fuel stream it is possible to provide a greater uniformity of the gaseous mixture entering the intake manifold. This reduces the possibility of non-vaporized fuel entering the engine which can pass out as un-burned or partially burned hydrocarbon pollutants.

The primary objective of this invention is to reduce carbonmonoxide and hydrocarbons emitted as pollutants resulting from incomplete combustion processes. This is achieved by providing a fuel mixture substantially devoid of liquid droplets.

The present invention contemplates a housing comprised of an upper and lower circular plates with a spacing ring provided therebetween. Positioned within the spacing rings is a baffle having a plate member and an upright perforated collar. The plate member has an outer dimensions less than the inner dimensions of the ring whereby an angular opening is maintained therebetween. The plate member is positioned by means of spacing rods attached thereto and resting on the base plate, thereby a passageway is formed between the baffle plate member and the base plate. The perforated collar extends from the plate member to the upper plate. The annular area between the perforated collar and the ring member is filled with fibrous material, such as steel wool. The fuel stream enters a port provided in the upper plate, passes through the perforated collar and through the fibrous material and out through a port provided in the base plate. The liquid droplets present in the fuel stream are captured by the two fibrous materials.

It will be seen that the present device has fewer parts than the prior art, has no moving elements to interfere with the flow of fuel stream, or to wear out, and is economical to manufacture.

Other objects and advantages of this device will be apparent on reference to the specifications and the drawings herein.

DESCRIPTION OF THE PREFERRED EMBODIMENT

Figure 1:
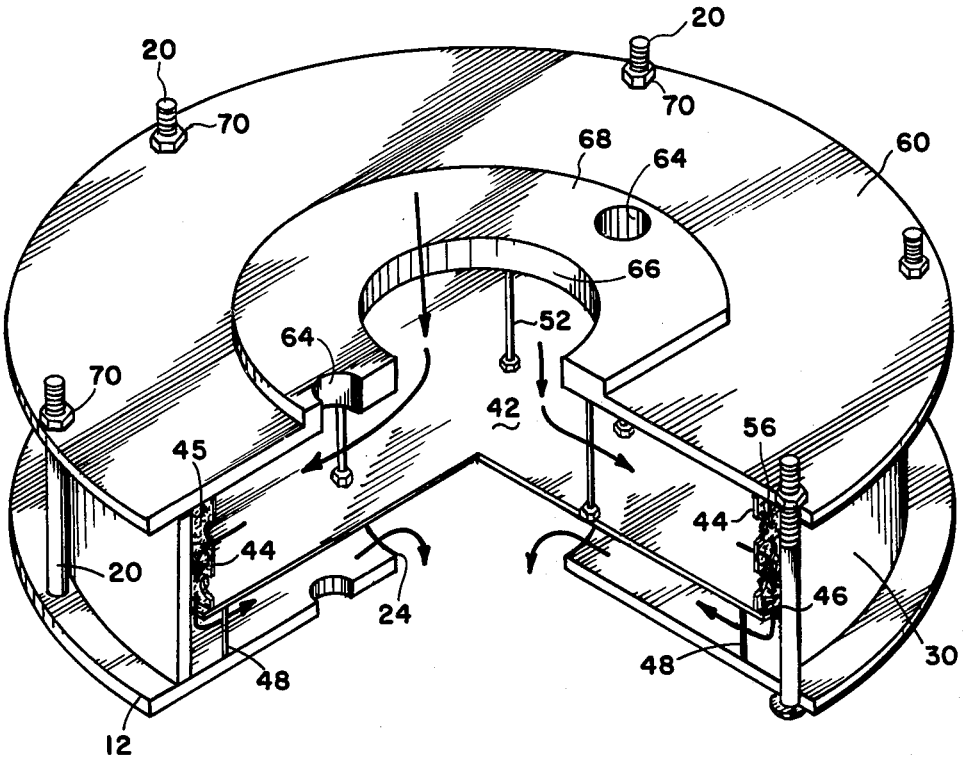
FIG. 1 is a perspective view of the present device with partial section removed to show its operative configuration.

Referring now to the drawings the vaporizer of the present invention represented by numeral 10 is shown with a section thereof removed to display the configuration of the particular elements comprising the device. As can be seen the fuel stream enters in the port provided in the upper plate and exits through a port provided in the base plate.

Figure 2:
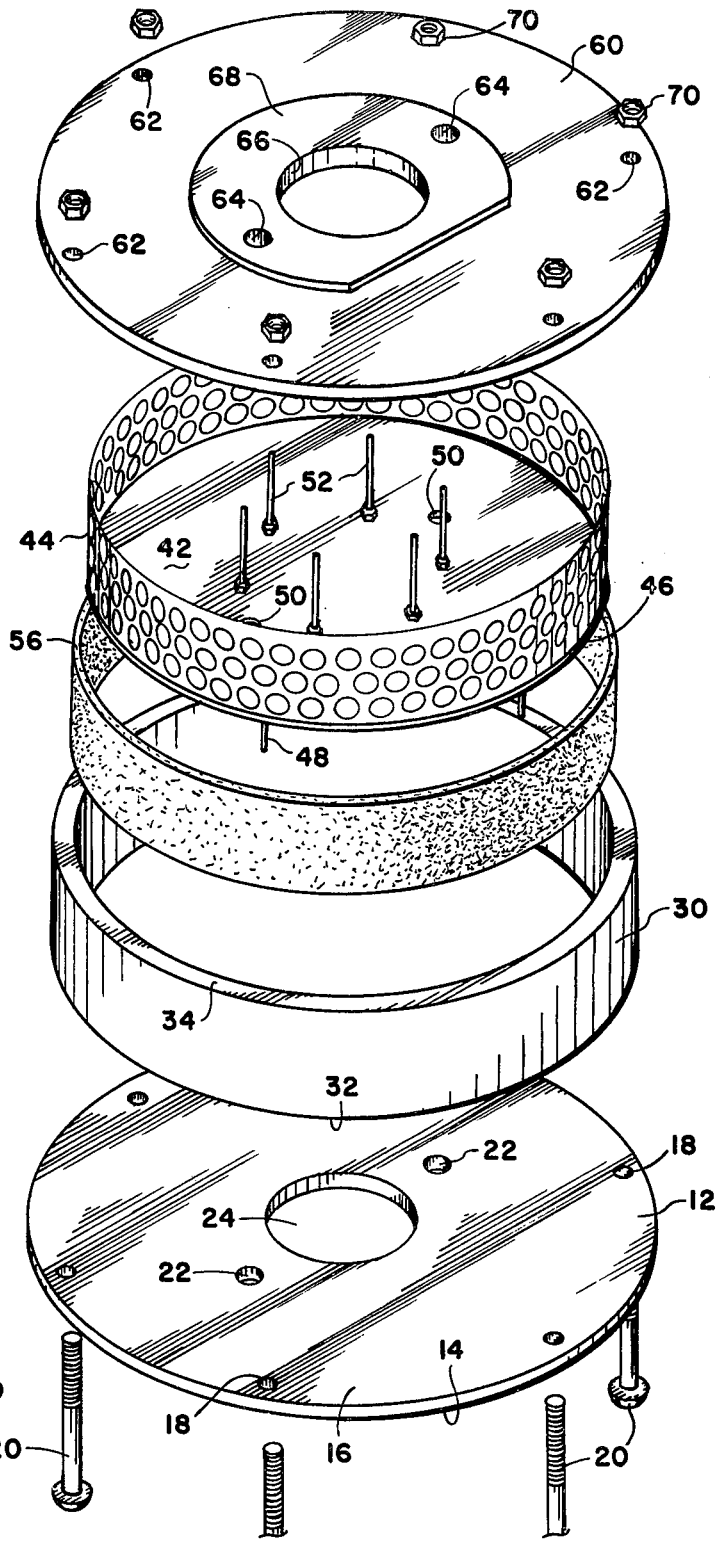
FIG. 2 is a perspective exploded view of the five elements comprising the present invention.

Referring to FIG. 2 the construction of the device 10 can be better understood. The vaporizer 10 comprises a base plate 12 having a lower surface 14 and an upper surface 16. A plurality of openings 18 are disposed in spaced relation adjacent the periphery of the base plate 12; said openings 18 receiving screws 20 therethrough. The base plate 12 is provided with openings 22 situated to facilitate the attachment of the base plate to the intake manifold, as will be apparent on further description of the specifications. An exit or outlet port 24 is centrally positioned in the base plate. The base plate 12 attaches to the intake manifold of an engine with the lower surface 14 resting thereon.

A tubular spacing ring 30 rests on the upper surface 16 and is dimensioned in height and inner radius to provide sufficient space for the disposition therein of other elements to be described. The spacing ring 30 has a lower edge 32 which seats on surface 16 of the base plate and an upper edge 34.

Within the interior of the spacing ring 30 is situated a baffle plate 42 and an upright perforated tubular collar 44. The baffle plate 42 is a circular plate dimensioned such that its outer dimension is less than the inner dimension of the spacing ring 30, thereby an annular opening 45 is provided therebetween. The opening 45 is better illustrated in FIG. 1. Referring again to FIG. 2, the perforated collar 44 is shown as a circular collar having an outer dimension less than the outer dimensions of the baffle plate 42 such that with the perforated collar 44 attached, a shoulder 46 is provided. Baffle plate 42 spaced about base plate 12 by a plurality of spacing rods 48. The length of the spacing rods 48 may be varied, but is preferably about one-third the height of the ring 30. Baffle plate 42 is additionally provided with openings 50 aligned with openings 22, and a plurality of support rods 52 which attach to an upper plate 60.

The annular area 45 is filled with fibrous material 56, supported on shoulder 46 and retained in position by the surrounding elements. An example of the fibrous material 54 is steel wool.

The inner edge 34 of the ring 30 provides support for upper plate 60 as shown in FIG. 1. The upper plate 60 is also given structural support by support rods 52. The upper plate 60 is provided, on its outer surface 61 with an integrally formed seat 68 particularly configured to receive a carburetor thereon. Openings 62 receive portions of bolts 20 therethrough and openings 64, together with seat 68 facilitate the attachment of the upper plate 60 to a carburetor (not shown).

The elements described are positioned as shown in FIG. 1 and held securely in place by screws 20 and nuts 70. The device is fitted on an engine, interposed between the carburetor and the inlet manifold.

OPERATION

The operation of the vaporizer of the present invention can be better understood by reference to FIG. 1. The fuel stream coming from the carburetor enters the inlet flows 66 between plates 60 and 42 and thence through openings in perforated collar 44 and through fibrous material 56.

The fuel stream from a carburetor comprises fuel vapors, and liquid droplets. For complete combustion it is desirable that the liquid droplets be vaporized rather than passed into the engine. This is accomplished by the perforated collar 44 and the fibrous material 56. As the fuel stream impinges upon the perforated collar 44 portions of the liquid droplets are arrested by non-perforated portions. Part of the fuel stream passes through the perforations 45 and into the fibrous material 56 which captures droplets present in the fuel stream. The liquid droplets are held in the fuel stream and vaporized. It should be emphasized that this aspect of the present invention is particularly important insofar that when the liquid droplets are removed from the fuel stream they are retained in the path of the fuel stream, and thus act as coalescing agents in capturing additional droplets from the fuel stream and at the same time maintaining the collected droplets in position.

As stated earlier, the primary objective of this invention is to reduce the amount of pollutants created by the engine and this function is accomplished by increasing the vaporization of the fuel in the fuel stream as described above. A prototype of this device was constructed and an actual experiment carried out and it was found that the device did in fact reduce the amount of carbonmonoxide and hydrocarbons emitted by an internal combustion engine. The pollutanta emitted at various engine speeds were measured and the following results obtained:

| With Standard Carburetor | | |
|---|---|---|
| Engine Speed (rpm) | CO (ppm) | Hydro-carbons (ppm) |
| 650 | 1.65 | 7.80 |
| 2100 (without air filter) | .60 | 4.80 |
| 2100 (with air filter) | .95 | 3.80 |
| **With The Present Invention Attached** | | |
| Engine Speed (rpm) | CO (ppm) | Hydro-carbons (ppm) |
| 680 | 1.80 | 7.60 |
| 2100 (without air filter) | .15 | 2.90 |
| 2100 (with air filter) | .13 | 2.00 |

It can be seen from the above that this invention is useful in reducing the amount of pollutants emitted.

It should be noted that in construction of this device the dimensions are chosen to correspond to the dimensions of the particular engine on which the device is to be used. Thus the inlet port 66 may be positioned differently than as shown and be dimensioned to correspond to the outlet port of the particular carburetor; similarly the exit port 24 may be made to correspond to the dimensions of the inlet to the intake manifold. Additionally changes in the position and dimensions of openings 22 and 64 may be made where necessary to conform to the particular engine.

While the invention has been described with a certain degree of particularity, it is manifest that many changes may be made in the details of construction and the arrangement of the essential elements of this invention without departing from the spirit and scope of this disclosure. It is understood that this invention is not limited to the embodiment set herein for purposes of exemplification, but is to be limited only by the scope of the attached claim or claims, including the full range of equivalency to which each element thereof is entitled.

What is claimed is:

1. For use with an international combustion engine having a carburetor and an intake manifold, a fuel vaporizer adapted to be interposed between the carburetor and the intake manifold, comprising:

a circular base plate having a lower surface and an upper surface, the lower surface adapted to rest on an intake manifold, the base plate having a central exit port therein;

a tubular spacing ring of outside diameter less than the diameter of the base plate, having a lower edge and an upper edge, the lower edge resting on the base plate upper surface;

a circular baffle plate of diameter less than the inner diameter of said spacing ring the baffle plate being positioned in the spacing ring providing an annular passageway therebetween, the baffle plate having an upper and lower surface;

an upright perforated tubular collar having a lower edge and an upper edge, the diameter of the perforated collar being less than the diameter of the baffle plate and less than the internal diameter of said spacing ring providing an annular space between the perforated collar and said spacing ring, the bottom edge of the perforated tubular collar resting on the upper baffle plate surface;

means of supporting said baffle plate above said base plate providing a passageway therebetween;

a circular upper plate having a lower surface and an upper surface, the lower surface being attached to the spacing ring upper edge and engaging said perforated collar upper edge, the upper surface of the upper plate adaptable to be attached to a carburetor, the upper plate having a central inlet port therein, the base plate, baffle plate, perforated collar, spacing ring and trop plate being secured in axial alignment;

fibrous material positioned between the exterior cylindrical surface of said collar and the interior cylindrical surface of said spacing ring;

whereby fuel laden air flowing from a carburetor passes through said inlet in said upper plate, through said perforated baffle, through said fibrous material, through the annular opening between said baffle plate and said spacing ring and out through said exit port in said base plate into an intake manifold.

* * * * *